US005573064A

United States Patent [19]

Hisaw

[11] Patent Number: 5,573,064

[45] Date of Patent: Nov. 12, 1996

[54] AUTOMATIC CATCH APPARATUS AND METHOD

[75] Inventor: Jack C. Hisaw, Carencro, La.

[73] Assignee: Specialty Machine & Supply, Inc., Scott, La.

[21] Appl. No.: 448,783

[22] Filed: May 24, 1995

[51] Int. Cl.[6] ..... E21B 47/00; E21B 23/01

[52] U.S. Cl. ..... 166/250.07; 166/385; 166/125

[58] Field of Search ..... 166/125, 243, 166/319, 341, 360, 382, 385, 250.07

[56] References Cited

U.S. PATENT DOCUMENTS

| | | | |
|---|---|---|---|
| 3,670,821 | 6/1972 | Tamplen | 166/385 |
| 3,677,346 | 7/1972 | Tamplen | 166/385 |
| 3,797,573 | 3/1974 | Crowe | 166/385 |
| 4,139,058 | 2/1979 | Gano | 166/360 |
| 4,154,298 | 5/1979 | Gano | 166/85.5 |
| 4,658,904 | 4/1987 | Doremus et al. | 166/336 |
| 5,327,975 | 7/1994 | Land | 166/369 |

*Primary Examiner*—Frank Tsay
*Attorney, Agent, or Firm*—C. Dean Domingue

[57] ABSTRACT

An apparatus for use in an oil and gas well bore is disclosed. Generally, the apparatus comprises of a mandrel and a housing slidable on the mandrel. The apparatus will also include an engaging member for engaging the walls of the well bore. A spring disposed about the mandrel urges the mandrel into contact with the engaging member.

11 Claims, 8 Drawing Sheets

AUTOMATIC CATCH APPARATUS AND METHOD

BACKGROUND OF THE INVENTION

This invention relates to an apparatus and method used in oil and gas well bores. More particularly, but not by way of limitation, this invention relates to an apparatus and method used in the pressure testing of reservoirs.

In the drilling and production of hydrocarbon reservoirs, operators will find it necessary to periodically obtain static and flowing pressures of the reservoir. This information is necessary for reservoir management in order to effectively deplete the reservoir.

Many advances in the drilling and completing of well bores have allowed for production of deep reservoirs. Further, well bores are becoming highly deviated which allow for the reaching of isolated reservoirs. Also, horizontal wells drilled through a productive zone allow for maximum production.

Various devices have been devised in order to obtain bottom hole pressures. Many of these devices are lowered into the well bore via wire line. The tool string may comprise a bottom hole pressure gauge, which can be a quartz type, with memory capability. Other types of work strings for positioning bottom hole pressure assemblies are possible such as coiled tubing, electric line, and braided line.

During the course of obtaining a bottom hole pressure, operational problems may occur. Many times the work string, such as the wire line, becomes entangled and the line breaks. Once the line breaks, the bottom hole assembly falls to the bottom of the well bore. Thereafter, costly retrieval operations (sometimes referred to as "fishing" operations) must be undertaken in order to retrieve the assembly, and many times the bottom hole assembly is lost. Thus, since the pressure and memory gauges are quite costly, the lost of these tools is highly undesirable. Also, the information collected is also lost.

Further, operators will many times require a flowing bottom hole pressure measurement. Thus, the bottom hole assembly is retrieved from the well bore with the reservoir actually producing reservoir fluids and gas. Due to the flow profile within the production tubing string, the bottom hole assembly may become suspended in the upward flow of reservoir fluids and gas which in effect causes the bottom hole assembly to be blown out of the well bore which is a very dangerous situation.

Therefore, there is a need for an apparatus that will preclude the loss of the bottom hole assembly when the wire line has broken. There is a further need for a device that will preclude the bottom hole assembly from being blown out the well bore.

SUMMARY OF THE INVENTION

An apparatus for use in an oil and gas well bore is disclosed. Generally, the apparatus comprises a mandrel and a housing slidable disposed on the mandrel. The apparatus will also include an engaging means, operatively positioned within the housing, for engaging the walls of the well bore. Also included will be urging means, disposed about the mandrel, for urging the mandrel into contact with the engagement means.

In one embodiment, the engaging means comprises a plurality of arms, with the arms having a first end and a second end. The first end of the arms will have a series of grooves, while the second end is pivotally attached to the housing.

The apparatus may further comprise biasing means, operatively associated with one end of the engaging arms, for biasing the first and second arm into contact with each other. In one embodiment, the mandrel will contain a first end and a second end, and the first end includes a conical section formed thereon so that as the conical section is urged into contact with the engaging arms, the arms extend outward through a window in the housing into engagement with the walls of the well bore.

In the preferred embodiment, the apparatus will have connected thereto a pressure means for obtaining both flowing and static pressures within the well bore. Generally, the entire bottom hole assembly is joined to a wire line disposed within the well bore. Other types of work strings are available for use.

A method for obtaining bottom hole pressures is also disclosed. Basically, the method comprises the steps of placing a bottom hole assembly into a well bore. The bottom hole assembly would include a mandrel connected to a work string. The mandrel has slidable disposed thereon a cylindrical member. Also included is slip means, positioned at least partially within a window section of the housing, for grasping the walls of the well bore. Urging means, disposed about said mandrel, for urging the mandrel into contact with the slip means is also provided. A pressure means is attached to the bottom hole assembly for obtaining the pressure of the well bore and in particular the reservoir. Next, the bottom hole assembly is positioned at a desired location in the well bore, and pressure measurements are then recorded.

Thereafter, the method further comprises the steps of withdrawing the bottom hole assembly from the well bore. In the case where an obstacle is encountered and the wire line parts, the bottom hole assembly is allowed to free fall so that the urging means urges the mandrel into contact with slip means so that the slip means expand into contact with the well bore thereby stopping the fall of the bottom hole assembly.

The method may alternatively include the steps of withdrawing the bottom hole assembly from the well, and during the step of withdrawing, the bottom hole assembly begins to be blown out the well bore due to the flow profile within the production tubing string. At this point, there is no longer any effective weight pulling downward on the housing; therefore, the urging means urges the mandrel into contact with slip means so that the slip means expand into contact with the well bore thereby stopping the ascent of the bottom hole assembly.

DESCRIPTION OF THE PREFERRED EMBODIMENTS

Figure 1:
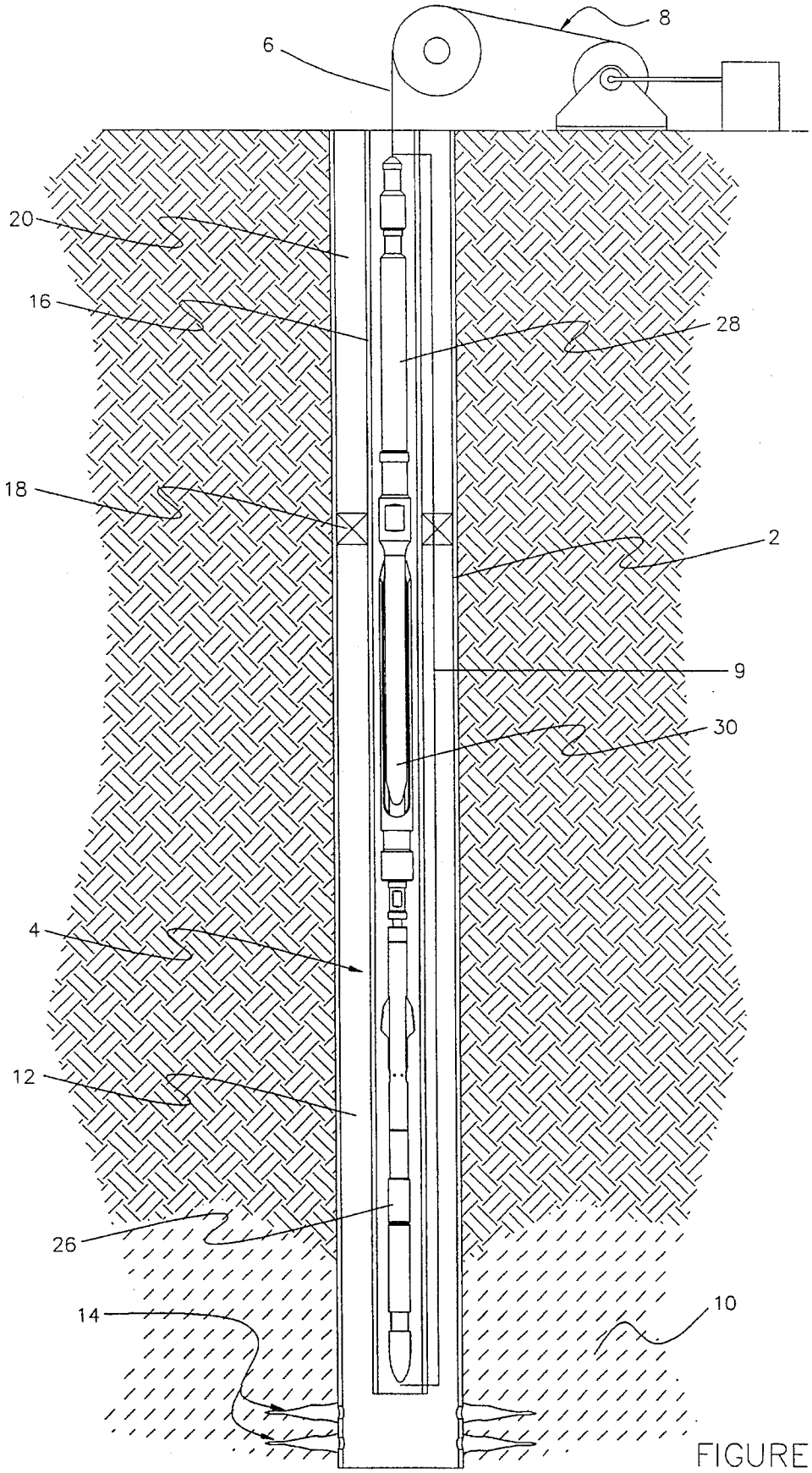
FIG. 1 is a schematic of a typical well bore with the invention being suspended therein by means of a wire line unit.

Referring now to FIG. 1, a typical well bore 2 with the apparatus 4 of the present application being suspended in the well bore 2 on a wire line is shown. The wire line unit 8 is located at the surface. As depicted in FIG. 1, the apparatus 4 is part of a bottom hole assembly 9 which also contains pressure means and a setting tool, both of which will be described hereinafter.

The well bore 2 is generally a casing string that intersects various subterranean reservoirs. Some of the reservoirs will contain commercial deposits of hydrocarbons. The well bore 2 will be completed to the reservoir 10 with the reservoir fluids and gas being produced into the lower annulus 12 through the perforations 14.

The well bore 2 may contain a production tubing string 16 with a production packer 18 being operatively associated therewith so that an upper annulus 20 and lower annulus 12 is formed. The production string 16 may contain nipple profiles (not shown) for the setting of the bottom hole assembly.

The bottom hole assembly 9 will contain setting means for setting the entire assembly 9 into the nipple profile, as is well understood by those of ordinary skill in the art. An example of a setting tool is sold under the name "GS" Running Tool, "X" Running Tool, or Hydraulic Soft Set Tool. During production of the reservoir 10, the reservoir fluids and gas enter into the lower annulus 12 and into the inner diameter of the production tubing 16 for delivery to the surface for separation and further processing (process facilities not shown).

The bottom hole assembly 9 will be connected to the wire line 6 while the opposite end of the apparatus 4 will have attached thereto pressure means 26 for measuring the pressure within the well bore 2. In one embodiment, the pressure means 26 will be a quartz type known as Amerada Pressure Gauge and available from Geophysical Research Corporation. It should be noted that like numbers appearing in the various figures refer to like components throughout the application. The bottom hole assembly also contains weight jars 28 and a set of spang jars 30.

Figure 2:
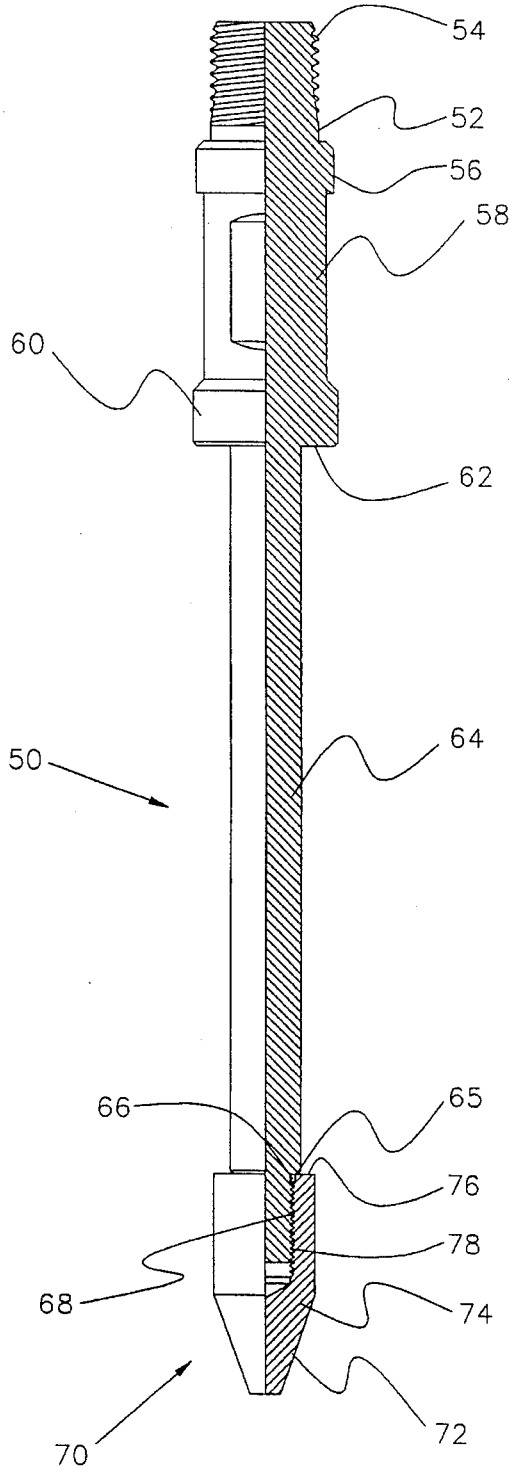
FIG. 2 is an enlarged partial sectional view of the mandrel of the present invention.

Referring now to FIG. 2, an enlarged partial cross-section of the mandrel means 50 of the present invention is depicted. Generally, the mandrel 50 comprises an outer cylindrical surface 52 that contains external thread means 54. The outer surface 52 to a second outer surface 56 that in turn extends to a third outer cylindrical surface 58. The surfaces 52, 56 and 58 together form a ledge, or fishing neck as commonly referred to those of ordinary skill in the art, which can be used in the retrieval of the bottom hole assembly 9 in the event that the bottom hole assembly becomes separated from the wire line 6.

The third outer surface 58 leads to a fourth outer surface 60 which concludes at the radial surface 62 that in turn leads to the outer cylindrical surface 64. The surface 64 ultimately concludes at the outer surface 66 which contains the external thread means 68. Also forming a portion of the mandrel will be the lower mandrel sub 70 also known as the cone. Generally, the lower mandrel sub comprises a conical surface 72 that leads to an outer cylindrical surface 74, with the outer surface 74 concluding at the radial shoulder 76. Extending radially inward is a bore that will contain internal thread means 78 that will make up to the external threads 68.

Figure 3:
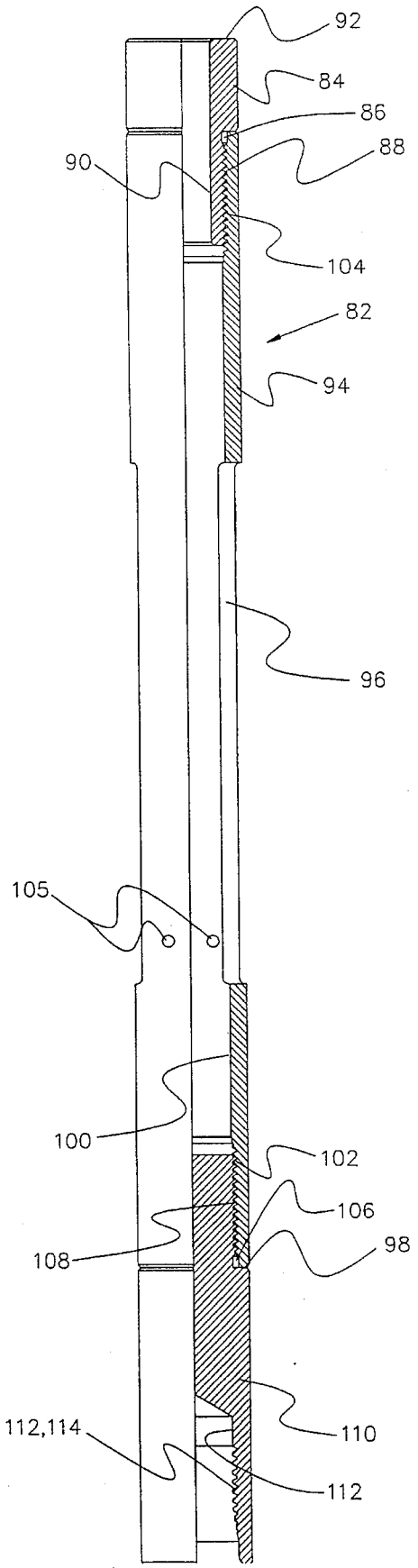
FIG. 3 is an enlarged partial sectional view of the housing of the present invention.

Referring now to FIG. 3, an enlarged partial cross-section of the housing member 82 of the present invention is depicted. Generally, the housing member contains an upper section that has a first outer surface 84 that will extend to a second outer surface 86 that will have contained thereon external thread means 88 which in turn leads to the inner bore 90. The inner bore 90 will conclude at the radial surface 92.

The housing member 82 also consist of an intermediate section that has a first outer surface 94 that extends to a section containing a plurality of elongated window sections 96 for placement of the slip means which will be described later in this application. The outer surface 94 terminates at shoulder 98. Extending radially inward of shoulder 98 is the internal bore 100 that will contain first thread means 102 and second thread means 104. The second thread means 104 engages the external thread means 88. The first thread means 102 engages the lower section of the housing member 82 to be described hereinafter. The intermediate section also contains apertures 105 for placement of a pin for the pivotal placement of the slip means, which will be described later in the application.

The housing member 82 also consist of a lower section that has a first outer cylindrical surface 106 that has contained thereon external thread means 108 that will engage with the thread means 102. The first outer surface 106 extends to the second outer surface 110. Extending radially inward will be the inner bore surface 112 that will have contained thereon the internal threads 114.

Figure 4:
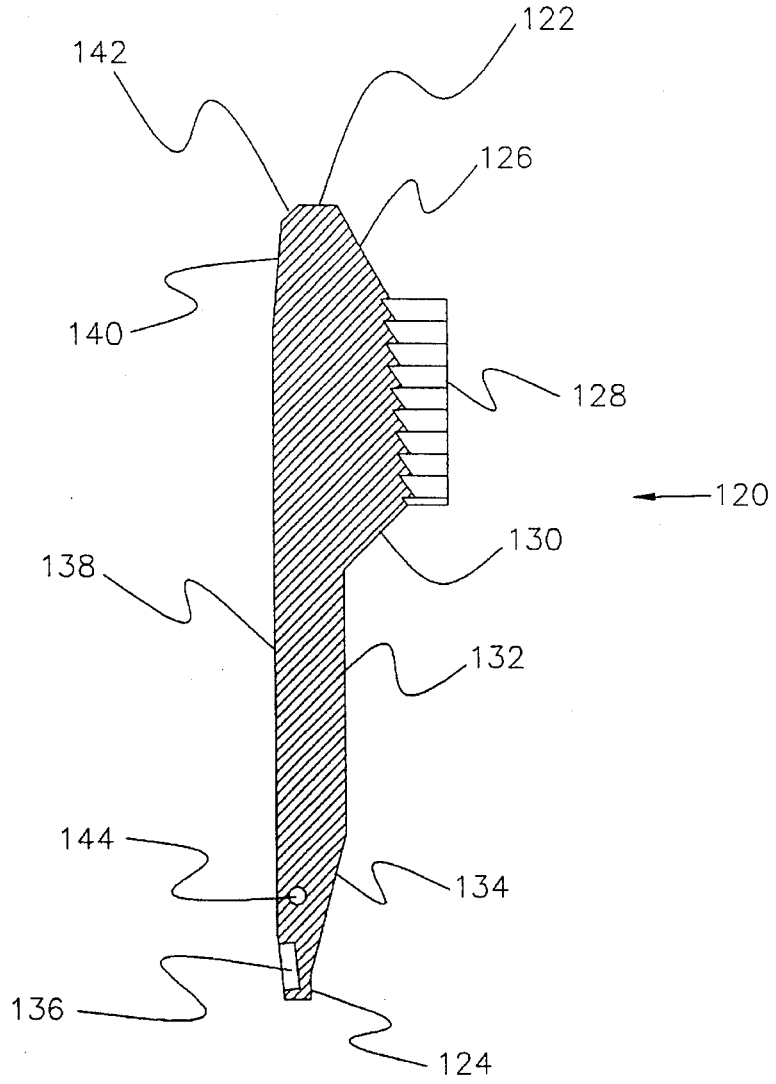
FIG. 4 is an enlarged partial sectional view of the slip means.

Reference is now made to FIG. 4 which is an enlarged cross-section of one arm of the slip means 120. Generally, the slip means contains a first end 122 and a second end 124. An outer surface 126 extends from the first end 122 with the outer surface being substantially arcuate in order to match the circumference of the well bore 2. The outer surface 126 is chamfered and extends to a plurality of engaging members (also known as a plurality of serrated edges) 128 for engaging the well bore 2 when extended as will be discussed later in the application. The engaging members 128 are generally formed of carburize teeth and are of a buttress thread form with a right hand helix.

The engaging members 128 will in turn extend to the chamfered outer surface 130, with the outer surface terminating at the surface 132. Extending from the surface 132 is another chamfered surface 134 that in turn extends to the radially flat second end surface 124. On the internal portion of the slip means 120 will be the first internal surface 136 that in turn stretches to a second internal surface 138 with the second internal surface extending to a chamfered internal surface 140 and thereafter advancing to the rounded end 142 and then concluding at the first end 122. Also shown in FIG. 4 is an aperture 144 that will receive a pin for pivotally attaching the slip means 120 to the housing 82 and in particular the aperture 105.

Figure 5:
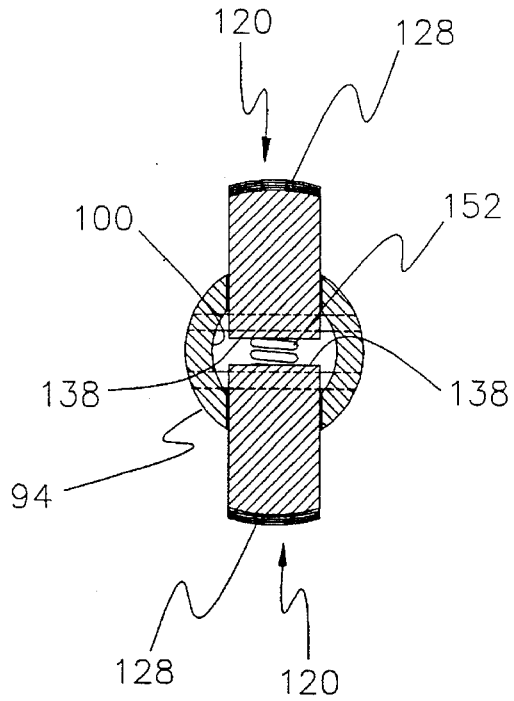
FIG. 5 is a cross-section of the apparatus taken along line A—A of FIG. 6.
Figure 6:
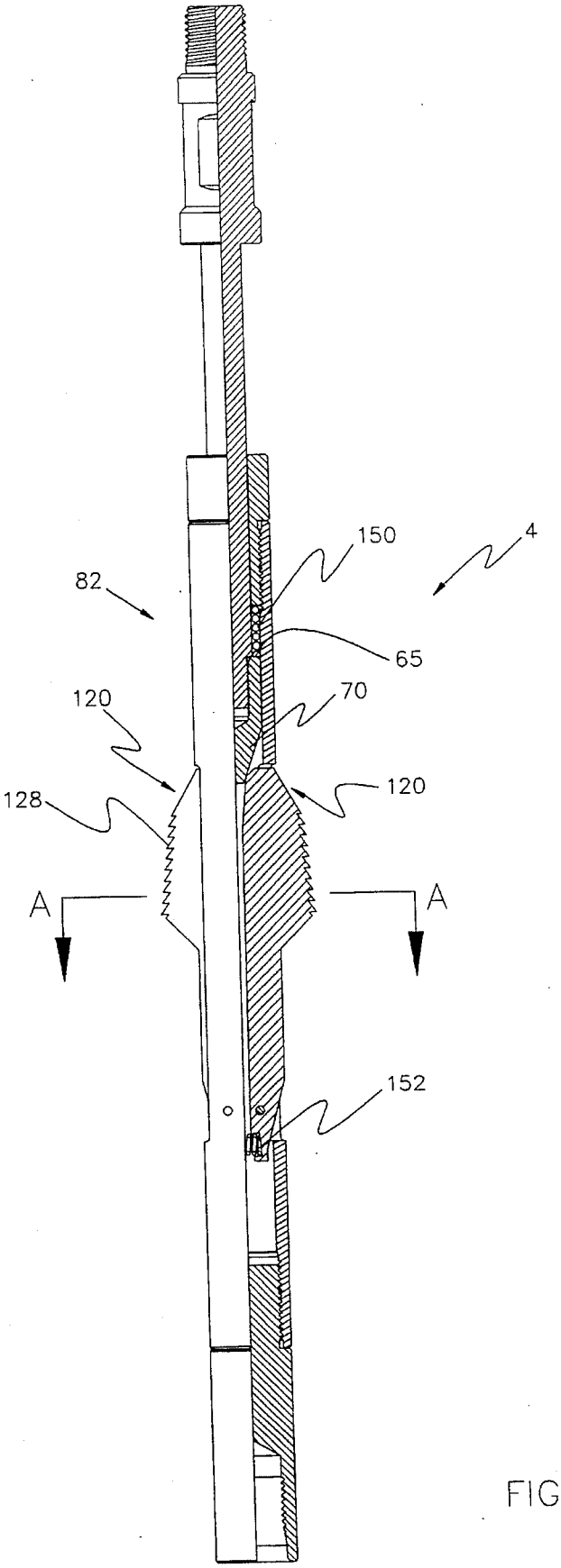
FIG. 6 is a partial sectional view of the apparatus of the present invention with the slip means being retracted.

Referring to FIG. 5, the illustration depicts a cross-section of the apparatus taken along line A—A of FIG. 6. This view shows the arcuate surface of the slip means 120, and in particular the engaging members 128, so that the wall of the tubing string 16 may be engaged. The slip means 120 are retracted within the housing member 82. In this position, the biasing means 152 acts to oppose the second ends 124 of both slip means 120.

OPERATION

AS seen in FIG. 1, the apparatus 4 is part of a bottom hole assembly 9 that is positioned within the well bore 2 on the wire line 6. Referring now to FIG. 6, when the apparatus 4 is run into the well bore 2, the weight of the bottom hole assembly 9 causes the housing member 82 to be pulled downward. In this position, the urging means 150 for urging the mandrel 50 downward relative to the housing member 82 is compressed. In the preferred embodiment, the urging means 150 is a conical spring. Therefore, the cone section 70, and in particular the surfaces 140 of the slip means 120 and the surface 72 of the cone, cooperate with one another so that the slip means 120 are allowed to retract as seen in FIG. 6. In this position, the slip means 120 are recessed within the window section 96 of the housing member 82.

In accordance with the teachings of the present invention, a biasing means 152 for biasing the two slip means 120, and in particular the second end 124 of the arms 120, in a position opposite one another as seen in FIGS. 5 & 6. Thus, when sufficient weight beneath the housing 82 forces the housing 82 downward relative to the mandrel, the urging means 150 becomes compressed. The slip means 120 are allowed to retract since the biasing means 152, which in the preferred embodiment is a conical spring, acts to separate the ends 124 of each arm 120 so that the ends 122 are thrust together.

Figure 7:
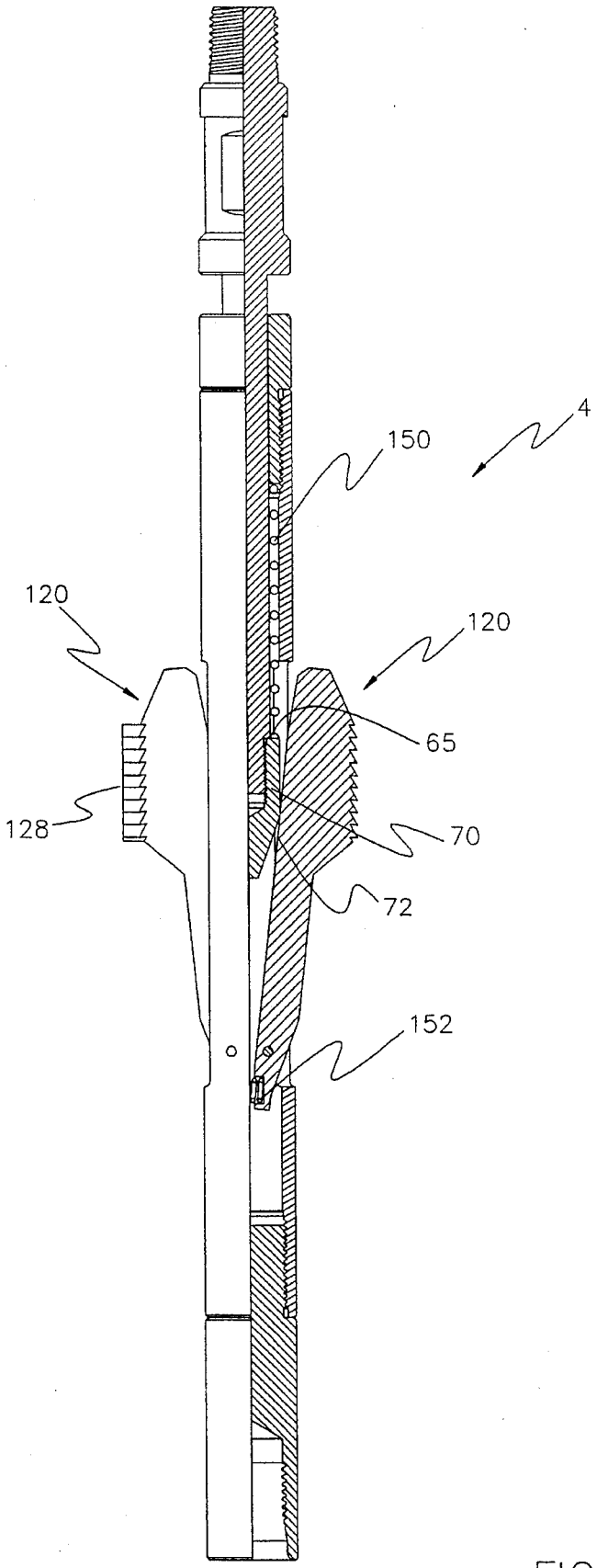
FIG. 7 is a partial sectional view of the apparatus of FIG. 6 with the slip means being expanded.

FIG. 7 depicts the case wherein there is no longer any effective gravitational weight acting on the housing. Such a case is where the wire line 6 becomes parted or alternatively the bottom hole assembly is blown out the well bore 2. As shown, the slip means 120 have been expanded.

The reasons for the parting of the wire line differ but some examples may be due to encountering a sharp object in the well bore or alternatively due to a restriction in the well that causes the operator to pull excessively on the wire line thereby causing the wire to break. The reasons for being blown out of the hole may include swabbing of the well fluids and gas when taking a flowing bottom hole pressure survey. The apparatus 4 will catch the walls of the production tubing 16 any time effective weight from beneath the apparatus 4 is lost.

Figure 8:
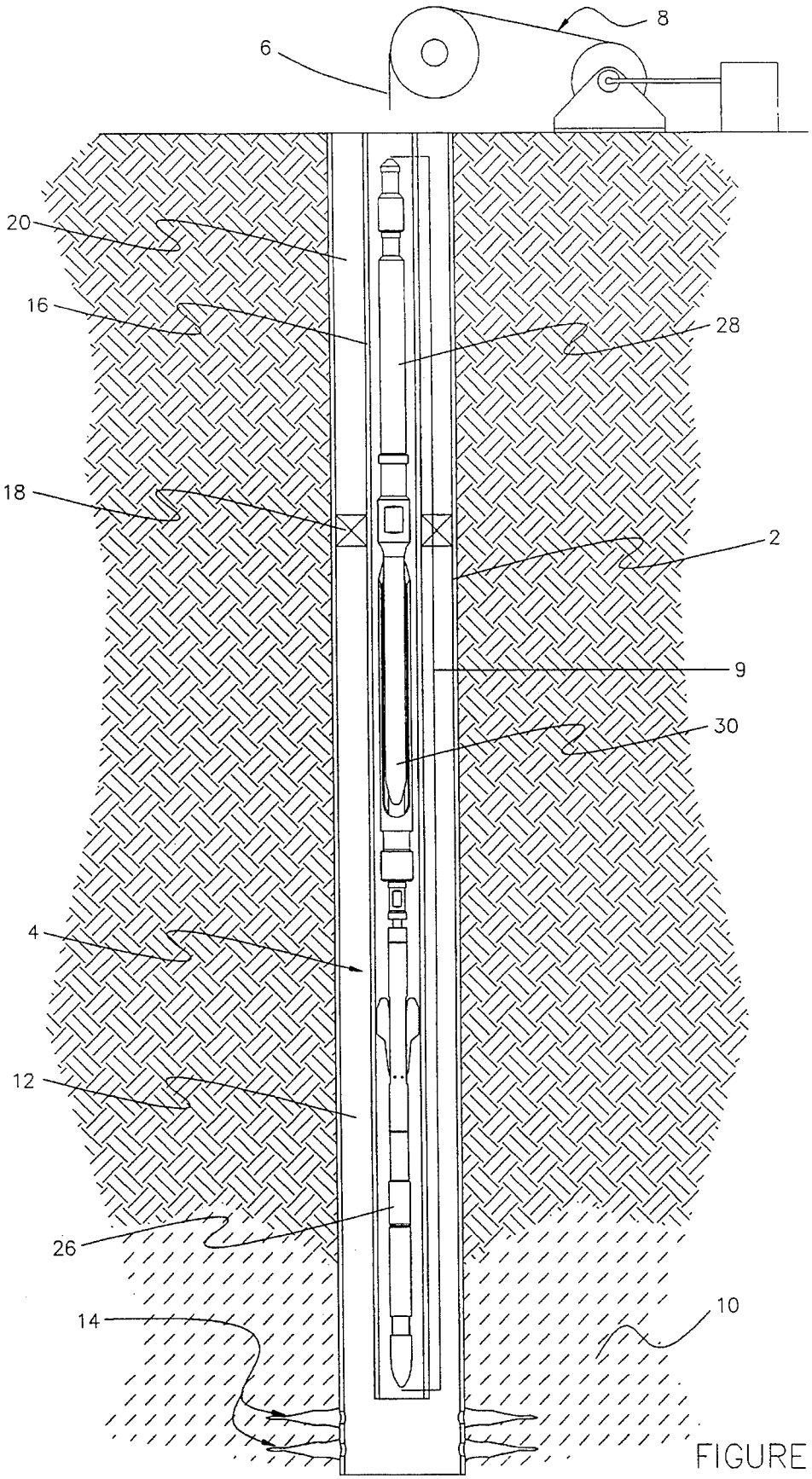
FIG. 8 is a schematic of a typical well bore with the invention as seen in FIG. 1 wherein the wire line has parted.

When such a situation occurs, the spring 150 acts against the radial surface 65 and forces the cone 70 downward relative to the housing member 82. As seen in FIG. 7, the conical surface 72 acts against the chamfered internal surface 140 of the dual slips 120 so that the dual slips 120 are forced outward into engagement with the production tubing 16. The engaging members 128, and in particular the individual teeth, imbed into the production tubing 16 walls. In this position, the biasing means 152 is compressed. It should be noted that FIG. 8 depicts the slip means 120 expanded due to a parted wire line.

Thus, regardless if the bottom hole assembly was moving up or down within the well bore, the slip means 120 will thereafter stop movement. In the case where the wire line has parted, the assembly may be retrieved by lowering a retrieving tool into the well bore 2. In the case where the tool was being blown out of the well bore, control of the flow can be reestablished i.e. the well is shut-in. After the well is static, the weight of the bottom hole assembly as well as the pull from the surface by the operator will cause the slips 120 to retract (due to the weight of the bottom hole assembly.

A method of soft-setting a bottom hole assembly is also disclosed. The bottom hole assembly will include a spring loaded collar stop, an Amerada Pressure gauge, the automatic catch apparatus of the invention disclosed herein, rope socket and a hydraulic running/pulling tool.

The method includes setting the collar stop by conventional means within a tubing collar. Next, the operator allows the tool string weight to be set down which has the effect of allowing the slip means to expand against the walls of the tubing. The conventional hydraulic pulling/running tool will release the bottom hole assembly, and the operator can pull out of the well bore.

Thus, the pressure gauges have been set down hole without any jarring. The pressure gauges cannot move down because of the collar stop, and can not go up because of the automatic catch apparatus.

Changes and modifications in the specifically described embodiments can be carried out without departing from the scope of the invention which is intended to be limited only by the scope o the appended claims.

I claim:

1. An apparatus for use in a well bore comprising:

a mandrel;

a housing slidable disposed on said mandrel, said housing having a window;

engaging means, positioned within said window of said housing, for engaging the walls of the well bore, and wherein said engaging means comprises a first arm and a second arm, said first arm and said second arm having a first end and a second end, with the first end having a series of grooves and the second end being pivotally attached to said housing and wherein said mandrel contains a first end and a second end, and wherein said first end includes a conical section formed thereon so that as said conical section is urged into contact with said arms, said arms extend outward through said window and into engagement with the walls of said well bore;

urging means, disposed about said mandrel, for urging said mandrel into contact with said engaging means;

biasing means, positioned at the second end of said first and second arm, for biasing the first and second arm into contact with each other.

2. The apparatus of claim 1 wherein said the second end of said mandrel contains connecting means for connecting said apparatus with a wire line disposed within the well bore.

3. The apparatus of claim 2 wherein said housing has a first end and a second end with the first end being slidably disposed about said mandrel and the second end is attached to pressure means for determining the pressure of the well bore.

4. A device for testing a reservoir in a well bore, with the device being attached to a work string comprising:

a mandrel connected to the work string;

a cylindrical member slidably disposed about said mandrel, with said cylindrical member containing an opening;

slip means, operatively positioned within said housing, for grasping the walls of the well bore;

pressure means, attached to said cylindrical member, for obtaining the pressure of the reservoir.

5. The apparatus of claim 4 further comprising:

activating means, disposed about said mandrel, for activating said slip means into contact with the walls of the well bore.

6. The apparatus of claim 5 wherein said cylindrical member has a section containing an opening, and wherein said slip means comprises:

a first arm having a first end and a second end and a second arm having a first end and a second end, with the first end of said first and second arm having a segment containing a plurality of serrations and wherein said first and second arm are positioned within the opening.

7. The apparatus of claim 6 wherein the second end of said first arm is pivotally attached to said cylindrical member, and the second end of said second arm is pivotally attached to said cylindrical member and wherein the device further comprises:

a spring operatiively associated with the second end of said first and second arm, with said spring being adapted to urge apart the first and second ends of said first and second arms.

8. The apparatus of claim 7 wherein said activating means includes a spring member disposed about said mandrel wherein said mandrel contains a first end and a second end and said first end includes a conical section formed thereon so that as said conical section is forced by said spring into contact with said arms, said arms will extend outward through a window formed in said cylindrical member, and into engagement with the walls of the well bore.

9. A method of obtaining a bottom hole pressure comprising the steps of:

placing a bottom hole assembly into a well bore on a wire line, said bottom hole assembly comprising: a mandrel connected to a work string; a cylindrical member slidably disposed about said mandrel; slip means, operatively positioned within said cylindrical housing, for grasping the walls of the well bore; pressure means, attached to said cylindrical member, for obtaining the pressure of the reservoir; and, urging means, disposed about said mandrel, for urging said mandrel into contact with said slip means obtaining a pressure of the reservoir.

10. The method of claim 9 further comprising the steps of:

withdrawing the bottom hole assembly from the well bore;

encountering an obstacle so that the wire line is parted;

allowing the bottom hole assembly to free fall back into the well bore;

expanding said slip means into contact with the well bore;

stopping the fall of said bottom hole assembly.

11. The method of claim 9 further comprising the steps of:

withdrawing the bottom hole assembly from the well bore;

accelerating the ascent of the bottom hole assembly from the well bore due to flow of reservoir fluids and gas;

expanding said slip means into contact with the well bore;

stopping the as,cent of said bottom hole assembly.

* * * * *